United States Patent [19]

Hillemeier et al.

[11] Patent Number: 4,824,022

[45] Date of Patent: Apr. 25, 1989

[54] METHOD OF AND APPARATUS FOR APPLYING A SPRAYED CONCRETE LAYER TO A SURFACE

[75] Inventors: Bernd Hillemeier, Wiesbaden; Günter Brockmann, Bad Homburg/Obereschbach; Richard Pohl, Walldorf, all of Fed. Rep. of Germany

[73] Assignee: Hochtief Aktiengesellschaft Vorm. Gebr. Helfmann, Fed. Rep. of Germany

[21] Appl. No.: 153,144

[22] Filed: Feb. 8, 1988

[30] Foreign Application Priority Data

Feb. 7, 1987 [DE] Fed. Rep. of Germany ..... 3703761

[51] Int. Cl.[4] ..... B28C 5/46

[52] U.S. Cl. ..... 239/407; 239/9; 239/419.3; 239/428; 366/3

[58] Field of Search ..... 239/8–10, 239/336, 311, 419.3, 422, 428, 407, 413; 406/118, 50; 366/3, 9

[56] References Cited

U.S. PATENT DOCUMENTS 1,935,977 11/1933 Geer ..... 239/336 X
2,543,517 2/1951 Anderson ..... 239/336
3,734,569 5/1973 Vingas ..... 406/118
3,740,260 6/1973 Winn ..... 239/8 X

FOREIGN PATENT DOCUMENTS 2032618 11/1970 France .

*Primary Examiner*—Andres Kashnikow
*Assistant Examiner*—Kevin P. Weldon
*Attorney, Agent, or Firm*—Herbert Dubno

[57] ABSTRACT

The apparatus for applying a sprayed concrete layer to a surface comprises a concrete feed pipe for a pumpable and sprayable concrete mixture made with water, a sprayer and a compressed air feed device for compressed air under a pressure of several bar from a compressed air source. The concrete feed pipe opens into the sprayer which has a compressed air connector device. The concrete mixture is sprayable with the compressed air. The compressed air feed device comprises a register including several compressed air chambers which connect to and open into the compressed air connector device. The individual compressed air chambers are connected with the help of control valves in alternating sequence to a power silo for loading a powdery concrete additive, particularly silica powder, or for blowing through a compressed air partial flow.

5 Claims, 2 Drawing Sheets

METHOD OF AND APPARATUS FOR APPLYING A SPRAYED CONCRETE LAYER TO A SURFACE

FIELD OF THE INVENTION

Our present invention relates to a method and to an apparatus for the spray emplacement of a concrete layer on a surface.

BACKGROUND OF THE INVENTION

An apparatus used for application of a sprayed concrete layer to a surface comprises a concrete feed pipe for a pumpable and sprayable concrete mixture made up with water, a sprayer and a compressed air feeder connected to a compressed air source.

The compressed-air-project metering device is under a pressure of several bar. The concrete feed pipe is connected to and opens into the sprayer which is also supplied with the compressed air. The concrete mixture is sprayed using the compressed air as a dispersing and entrainment medium.

The known apparatus includes a compressed air feed device which includes a pipelike duct extending to the air regulating, metering and valve devices, which is connected to the compressed air source and connects and opens into the sprayer. The compressed air is provided at a feed pressure of several bar, e.g. from 5 to 8 bar, which is the static pressure of the compressed air source.

In this way the sprayed concrete mixture can be effectively emplaced, chiefly by a sprayer lance, head or hose.

The compressed air can be relieved (expanded) in the sprayer and, to a greater degree, on issuing from the spray lance or head or in or upon the emergence from the sprayer hose.

For example the sprayer can comprise for example a linear guide pipe section for the compressed air and a pipe connector inclined to that pipe section opening into it for the concrete mixture.

We have found that it is possible to mix the sprayed concrete mixture with a powdery concrete additive. This helps avoid an undesirably high moisture content in the freshly made concrete layer. As a result, we can improve the application of a concrete layer to a surface substantially by directly mixing with the concrete, silica powder immediately prior to spraying or during spraying.

The silica powder eagerly absorbs excess water from the sprayed concrete mixture and allows application of a substantially thicker sprayed concrete layer.

By silica powder we mean amorphous or colloidal silicic acid (colloidal silica) which is made by high temperature hydrolysis or colloidal silica precipitation process.

The silica powder has a very large surface area, e.g. 25 $m^2/g$ or substantially more. Usually about 1 to 10 weight percent of silica powder relative to the hydraulic cement component of the concrete mix is used. Practical considerations often demand that other powdery concrete additives be used in addition or alternatively.

OBJECTS OF THE INVENTION

It is an object of our invention to provide an improved apparatus and method for applying a concrete layer to a surface which avoids drawbacks of earlier techniques such as limited application thickness or excessive water in the mix.

It is another object of our invention to provide an improved apparatus for application of a sprayed concrete layer to a surface which have the advantages described in which a powdery concrete additive is introduced into the concrete mixture, especially in the form of amorphous colloidal silica powder, particularly in an amount of from 1 to 10 weight percent or more relative to the cement compound of the concrete.

It is an further object of our invention to provide an improved apparatus for applying a sprayed concrete layer to a surface in which a powdery concrete additive is introduced into the sprayed concrete mixture, especially in the form of silica powder, to absorb moisture during the hardening of the concrete layer.

SUMMARY OF THE INVENTION

These objects and others which will become more readily apparent hereinafter are attained in accordance with our invention in an apparatus for application of a sprayed concrete layer to a surface comprising a concrete feed pipe for a pumpable and sprayable concrete mixture made with water, a sprayer and a compressed air feed device for compressed air issuing from a compressed air source which is under a pressure of several bar, preferably 5–8 bar. The concrete feed pipe connects and opens into the sprayer which has a compressed air connector fitting. The sprayed concrete mixture is sprayably entrained by the compressed air.

According to our invention the compressed air feed device comprises a register of several compressed air chambers each of which opens into the compressed air connector duct. The individual compressed air chambers are connectable selectively by a number of control valves in alternating sequence to a powder silo for loading a powdery concrete additive, particularly the amorphous silica powder, or for blowing a compressed air partial flow therethrough. The rhythm of the switching is so selected that a predetermined flow rate of pulverized or powdery concrete additive is introduced into the sprayed concrete mixture.

One advantageous feature of our invention provides a very precise metering or dosing of additive: the individual compressed air chambers at their downstream and upstream ends have a plurality of control valves and moreover in the region between the control valves at the opposing downstream and upstream ends these chambers are connected to the powder silo by a return pipe and by a connecting duct with a pump, e.g. a blower or a membrane pump.

When the concrete additive tends to flocculate or coagulate, our invention advantageously provides that the compresesd air chambers are pipelike ducts which have a sufficient length for very homogeneous mixing of the compressed air with the concrete. For the same reason the powder silo can be constructed as a fluidizing device for the powdery concrete additive.

When one operates with the apparatus according to our invention the switching of the control valves occurs without difficulty so that disturbing compressed air surges do not impair the spraying process. Advantageously the compressed air partial flows through both compressed air chambers are overlapped to smooth surges during the valve switching steps.

The advantages attained by our invention include an apparatus which can provide a sprayed concrete mixture with a concrete additive during spraying on a surface to be covered with concrete and of course immediately before spraying so that the concrete additive acts immediately after spraying or during spraying.

Particularly in this way silica powder can be mixed into the concrete mix in an amount of 1 to 10 weight percent or more relative to the cement component of the sprayed concrete mixture. The pumpable and sprayable concrete mixture is thus transformed by the excess water more or less instantaneously into a semihardened state—or a state of low moisture content, since the silica powder or other additive eagerly and spontaneously soaks up the excess water. The sprayed concrete can be applied in a layer thickness of 15 cm and more overhead and in a layer thickness of about 25 cm to a vertical wall. The apparatus according to our invention is characterized by simplicity and reliability.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
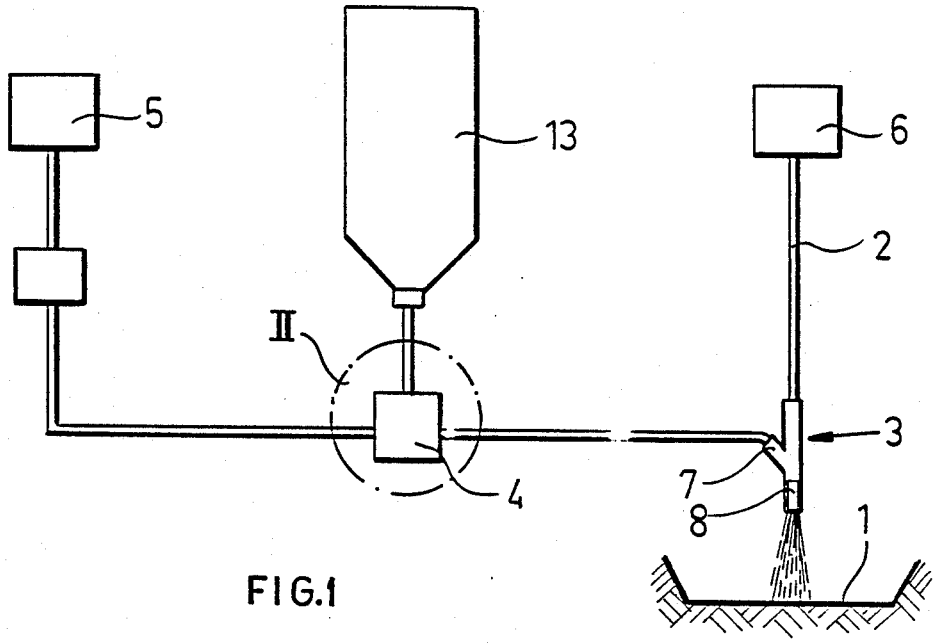
FIG. 1 is a diagrammatic view of an apparatus for applying a sprayed concrete layer to a surface according to our invention.
Figure 2:
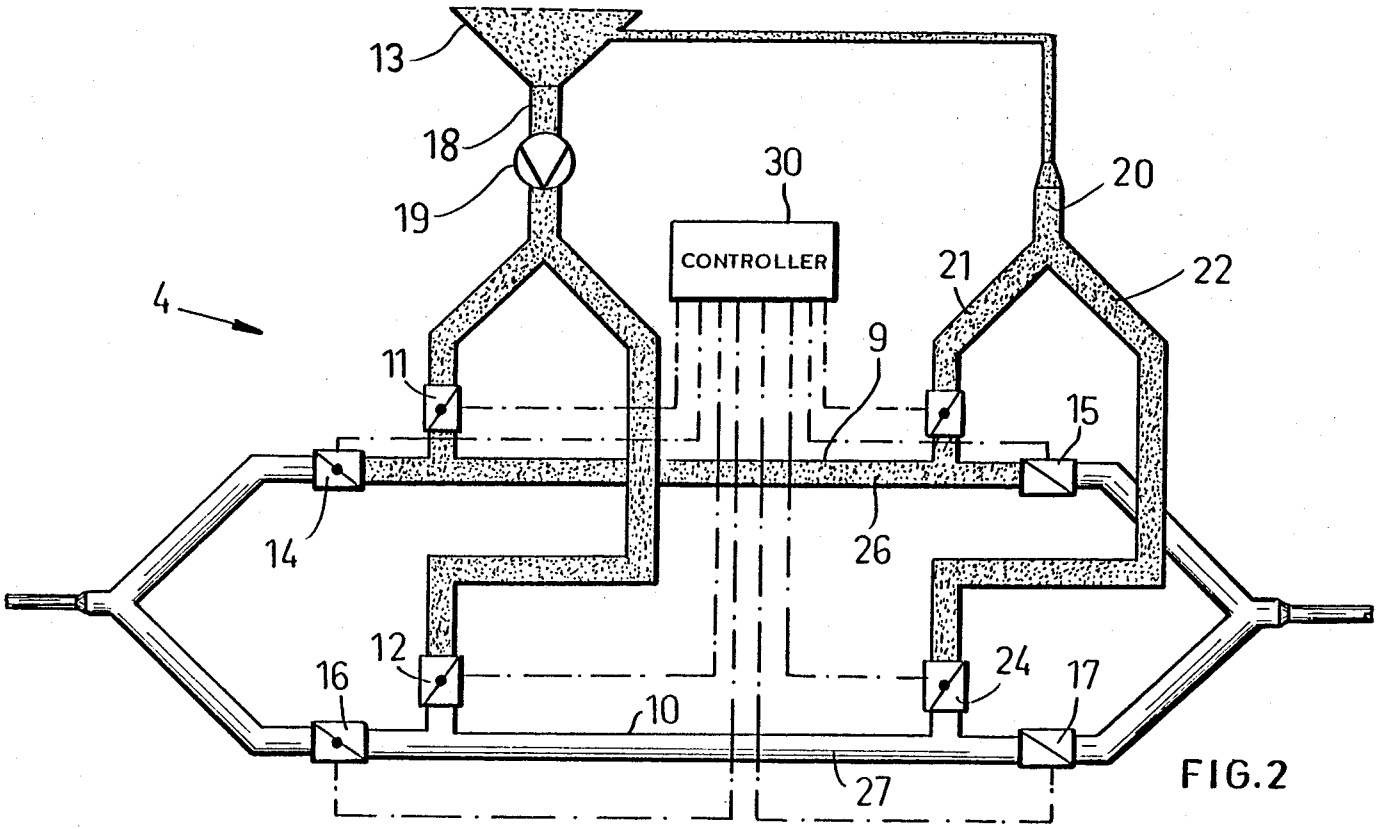
FIG. 2 is an enlarged portion of the diagrammatic view of the apparatus shown in FIG. 1 which is indicated with the dot-dashed circle A in FIG. 1.

The apparatus shown in FIGS. 1 and 2 is used for applying a sprayed concrete layer onto a surface 1. It basically comprises a concrete feed pipe 2 for a pumpable and sprayable concrete mixture made with water, a sprayer 3 and a compressed air feed device 4 for compressed air which issues from a compressed air source 5 under a pressure of several bar.

The concrete feed pipe 2 is connected to a concrete pump 6 and opens into the sprayer 3 which has a compressed air connector device 7. The ready made sprayed concrete mixture is thus sprayable with the compressed air. A sprayer outlet device 8 or a sprayer hose can be connected to the sprayer 3.

The compressed air feed device 4 comprises a register of at least two compressed air chambers 9, 10, which open into the compressed air connector device 7.

The individual compressed air chambers 9, 10 are connectable by control valves 11, 12 in alternating sequence to a powder silo 13 for a powdery concrete additive, particularly for silica powder, and of course so that they are loadable in alternating sequence with the powdery concrete additive. During each of their other half cycles, they can be blown through by a compressed air partial flow. The compressed air chambers 9, 10 are dimensioned and the rhythm of switching between them is set so that a predetermined flow rate of powdery concrete additive can be added to a predetermined flow rate of the sprayed concrete mixture.

The individual compressed air chambers 9, 10 with control valves 14 and 15 as well as 16 and 17 at their upstream and downstream ends are connected to the powder silo 13 by a connecting duct 18 having a pump 19 which is a blower or a membrane pump and by a return pipe 20. The control valves 23 and 24 are located in the connecting segments 21 and 22 of the return pipe 20. The downsteam end control valves 15, 17 can, if desired, be nonreturn valves which are controlled by the compressed air flow itself.

The compressed air chambers 9, 10 are pipelike ducts which have a length sufficient for thorough mixing of the compressed air with the powdery concrete additive. The powder silo 13 is appropriately a fluidizing device for the powdering concrete additive.

Figure 3:
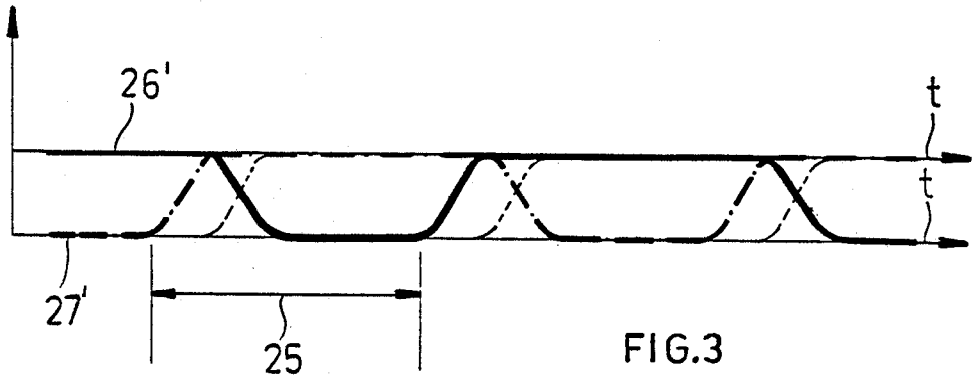
FIG. 3 is a graph showing the process for operation of the apparatus according to FIG. 1.

In FIG. 3 a graphical representation of the process according to our invention is shown. Two traces 26', 27' are shown on this graph which correlate with each of the different compressed air chambers 9, 10. The pressure, P, is shown on the ordinate and time, t, on the abscissa.

The pressure may be from 5 to 7 bar and is raised and lowered on switching. In a region 25 the compressed air partial flows 26 and 27 flowing through the different compressed air chambers 9, 10 are superimposed with surge smoothing in the valve switching steps and of course in a time interval of from 0.3 to 0.5 sec (although the time scale is not shown on the abscissa). On introduction of the powdery concrete additive to the corresponding compressed air chamber 9, 10 a reduced pressure, for example 1 to 2 bar, according to operation of the switched on blower and/or the switched on membrane pump 19, exists, and the compressed air chamber 9 or 10 may be filled without difficulty with the powdery concrete additive because a feedback through the return pipe 20 is permitted. The timer/controller 30 operates the valves to provide the sequency described.

We claim:

1. In an apparatus for applying a sprayed concrete layer to a surface comprising a concrete feed pipe for a pumpable and sprayable concrete mixture made with water, a sprayer and a compressed air source having a pressure of several bar, said concrete feed pipe opening into a sprayer compressed air connector device, said sprayed concrete mixture being sprayable by entrainment with compressed air from said source, the improvement which comprises a compressed air feed device formed with, a register having a plurality of compressed air chambers which open into said compressed air feed connector, individual ones of said compressed air chambers being connectable by a plurality of control valves in alternating sequence to a powder silo for loading of the chambers with a powdery concrete additive or for blowing through of a compressed air partial flow, selectively, to mix said additive with the concrete mixture, the upstream and downstream end of said individual ones of said compressed air chambers each having at least one control valve, in the region between said control valves at said upstream end and said downstream end said compressed air chambers being connected to said powder silo by a connecting duct with a pump and by a return pipe.

2. The improvement as defined in claim 1 wherein said powdery concrete additive comprises silica powder.

3. The improvement as defined in claim 1 wherein said compressed air chambers each comprise a pipelike duct.

4. An apparatus for applying a sprayed concrete layer to a surface comprising:

a concrete feed pipe for a pumpable and sprayable concrete mixture;

a sprayer with a compressed air connector device to which said concrete feed pipe is connected;

a compressed air source containing compressed air at several bar;

a powder silo for a powdery concrete additive; and a compressed air feed device connected to said compressed air source and said powder silo and to said compressed air connector device of said sprayer for metering a plurality of partial flows of said compressed air and said powdery concrete additive, said compressed air feed device including a register comprising at least two compressed air chambers which open into said compressed air feed connector and are connectable by a plurality of control valves in alternating sequence to said powder silo for loading said powdery concrete additive into said chambers or connecting said chambers to said compressed air source for blowing said partial flows of said compressed air and said powdery concrete additive through said chambers, said register containing two of said compressed air chambers, the downstream and upstream ends of each of which having one of said control valves, and between said control valves at said upstream and said downsteam ends each of said compressed air chambers being connected to said powder silo respectively by both a connecting duct having a pump and a return pipe.

5. The apparatus as defined in claim 4 wherein each of said pressurized chambers comprises a pipe like duct.

* * * * *